US007666295B2

(12) United States Patent
Patrick et al.

(10) Patent No.: US 7,666,295 B2
(45) Date of Patent: Feb. 23, 2010

(54) UNINHIBITED ELECTRICAL INSULATING OIL

(75) Inventors: John Kristopher Patrick, Clinton, MS (US); Lance A. Puckett, Madison, MS (US); Jimmy M. Rasco, Vicksburg, MS (US); H. Don Davis, Ridgeland, MS (US)

(73) Assignee: Ergon Refining, Inc., Jackson, MS (US)

( * ) Notice: Subject to any disclaimer, the term of this patent is extended or adjusted under 35 U.S.C. 154(b) by 793 days.

(21) Appl. No.: 11/255,086

(22) Filed: Oct. 20, 2005

(65) Prior Publication Data

US 2007/0090016 A1 Apr. 26, 2007

(51) Int. Cl.
*C10M 101/02* (2006.01)
*H01B 3/22* (2006.01)

(52) U.S. Cl. ..... 208/19; 208/18; 252/570; 585/6.3; 585/6.6

(58) Field of Classification Search ..... 208/18, 208/19; 252/570
See application file for complete search history.

(56) References Cited

U.S. PATENT DOCUMENTS

| | | | | | |
|---|---|---|---|---|---|
| 2,921,011 | A | | 1/1960 | Ordelt et al. | |
| 3,303,125 | A | | 2/1967 | Marter et al. | |
| 3,419,497 | A | | 12/1968 | Rocchini et al. | |
| 3,617,473 | A | | 11/1971 | Lipscomb, II | |
| 3,625,878 | A | | 12/1971 | Gourlaouen et al. | |
| 3,640,868 | A | | 2/1972 | Rocchini et al. | |
| 3,715,302 | A | * | 2/1973 | Mills et al. | 208/14 |
| 3,759,817 | A | | 9/1973 | Mills et al. | |
| 3,839,188 | A | | 10/1974 | Mills et al. | |
| 3,839,189 | A | | 10/1974 | Mills et al. | |
| 3,904,507 | A | | 9/1975 | Mills | |
| 3,925,220 | A | | 12/1975 | Mills | |
| 3,932,267 | A | | 1/1976 | Lewis et al. | |
| 4,018,666 | A | | 4/1977 | Reid et al. | |
| 4,033,854 | A | | 7/1977 | Ohmori et al. | |
| 4,062,791 | A | | 12/1977 | Masunaga et al. | |
| 4,069,166 | A | | 1/1978 | Masunaga et al. | |
| 4,070,297 | A | | 1/1978 | Masunaga et al. | |
| 4,072,620 | A | | 2/1978 | Masunaga et al. | |
| 4,082,866 | A | | 4/1978 | Link | |
| 4,124,489 | A | | 11/1978 | Reid | |
| 4,125,479 | A | | 11/1978 | Chesluk et al. | |
| 4,140,618 | A | * | 2/1979 | Mead et al. | 208/3 |
| 4,170,543 | A | | 10/1979 | Lipscomb, II et al. | |
| 4,240,917 | A | | 12/1980 | Pearce, Jr. et al. | |
| 4,303,499 | A | * | 12/1981 | Geistert et al. | 208/33 |
| 4,324,933 | A | * | 4/1982 | Kimura et al. | 585/6.6 |
| 4,518,481 | A | | 5/1985 | Marin | |
| 4,542,246 | A | | 9/1985 | Matsunaga et al. | |
| 4,584,129 | A | | 4/1986 | Katayama | |
| 4,731,495 | A | | 3/1988 | Katayama | |
| 4,760,212 | A | | 7/1988 | Katayama | |
| 4,770,763 | A | | 9/1988 | Kusayanagi et al. | |
| 4,846,962 | A | | 7/1989 | Yao | |
| 5,167,847 | A | * | 12/1992 | Olavesen et al. | 508/110 |
| 5,809,628 | A | * | 9/1998 | Davis et al. | 29/458 |
| 6,187,979 | B1 | * | 2/2001 | Ido et al. | 585/10 |
| 6,214,776 | B1 | * | 4/2001 | Angelo et al. | 508/281 |
| 6,315,920 | B1 | * | 11/2001 | Kent et al. | 252/73 |
| 6,355,850 | B1 | | 3/2002 | Angelo et al. | |
| 6,669,872 | B2 | * | 12/2003 | Kent et al. | 252/570 |
| 6,790,386 | B2 | | 9/2004 | Fefer et al. | |

FOREIGN PATENT DOCUMENTS

| | | |
|---|---|---|
| JP | 09-272891 | 10/1997 |
| JP | 11-329079 | 11/1999 |

OTHER PUBLICATIONS

Shell Diala® Oils A & AX Electrical insulating oil (product literature from Shell Oil Co.).
"Electrical Oils Tests and Specifications" page printed from Shell Lubricants in the USA website at http://www.shell-lubricants.com/Electrical/tests.html on Oct. 6, 2005, 2 pages.
Shell Oil Company press release dated Feb. 8, 2000 downloaded from website: http://piersystem.com/go/doc/9/2943/?printerfriendly=1 on Oct. 6, 2005, 1 page.
Dunwell-Petro Chemical Co., Ltd., product information sheet "Dunwell Base Oil/Stock SN70" downloaded from website: http://www.alibaba.com/member/dunwellgroup/product.html on Oct. 19, 2005, 2 pages.
NYNAS Product Data Sheet entitled "Naphthenics Product Data Sheet, Nynas Base Stock-T9" dated Jan. 20, 2004, 1 page.
IEC 60296 (Ed. 3.0 b:2003) (40 pages).
ASTM D 3487-00 (4 pages).
BS 148:1998 (13 pages).
Abstract for Brown et al., "The Composition of Petroleum Distillates as Revealed by Their Sulfonates" (ASTM, 1958) (1 page).
"Napthenic crude", http://www.energy.eu/dictionary/data/1145.html (1 page).
"Paraffinic crude oil", http://www.energy.eu/dictionary/data/1283.html (1 page).
Instructions for completing U.S. Department of Energy Form EIA-810 (Monthly Refinery Report) (7 pages), downloaded from www.eia.doe.gov/pub/oil_gas/petroleum/survey_forms/eia810i.pdf.

* cited by examiner

*Primary Examiner*—Ellen M McAvoy
(74) *Attorney, Agent, or Firm*—IPLM Group, P.A.

(57) ABSTRACT

An uninhibited electrical insulating oil is prepared by blending a severely hydrotreated naphthenic distillate base oil having a viscosity of from about 50 to about 80 SSU at 38° C. and an aniline point from about 63° to about 84° C. with a solvent extracted, non-hydrogenated paraffinic distillate having at least 9.0 wt. % aromatic content.

22 Claims, No Drawings

UNINHIBITED ELECTRICAL INSULATING OIL

TECHNICAL FIELD

This invention relates to uninhibited electrical oils, including transformer oils.

BACKGROUND

Electrical insulating oils are sometimes formulated by adding synthetic oxidation inhibitors such as di-t-butyl-p-cresol or di-t-butyl phenol. To meet certification requirements in some jurisdictions, synthetic oxidation inhibitors can not be employed. Oils formulated without such synthetic inhibitors are sometimes referred to as "uninhibited" electrical oils. References relating to synthetically inhibited or uninhibited electrical insulating oils include U.S. Pat. Nos. 3,932,267 (Lewis et al.), U.S. Pat. No. 4,018,666 (Reid et al.), U.S. Pat. No. 4,062,791 (Masunaga et al. '791), U.S. Pat. No. 4,070,297 (Masunaga et al. '297), U.S. Pat. No. 4,082,866 (Link), U.S. Pat. No. 4,124,489 (Reid), U.S. Pat. No. 4,125,479 (Chesluk et al.), U.S. Pat. No. 4,170,543 (Lipscomb, II et al.), U.S. Pat. No. 4,240,917 (Pearce, Jr. et al.), U.S. Pat. No. 4,542,246 (Matsunaga et al. '246), U.S. Pat. No. 4,846,962 (Yao), U.S. Pat. No. 6,355,850 B1 (Angelo et al.), U.S. Pat. No. 6,689,872 B2 (Kent et al.) and U.S. Pat. No. 6,790,386 B2 (Fefer et al.), and SHELL DIALA® OILS A & AX Electrical insulating oil (product literature from Shell Oil Co.)

SUMMARY OF THE INVENTION

The present invention provides, in one aspect, a method for making an uninhibited electrical insulating oil comprising blending severely hydrotreated naphthenic distillate base oil having a viscosity of from about 50 to about 80 SSU at 38° C. (100° F.) and an aniline point from about 63° to about 84° C. (from about 145° and about 180° F.) with solvent extracted, non-hydrogenated paraffinic distillate having at least 9.0 wt. % aromatic content to provide a blend that meets one or more of IEC 60296 (Ed. 3.0 b:2003), ASTM D 3487-00 or 148:1998 (Class II).

The invention provides, in another aspect, an uninhibited electrical insulating oil comprising a blend of severely hydrotreated naphthenic distillate base oil having a viscosity of from about 50 to about 80 SSU at 38° C. and an aniline point from about 63° to about 84° C. with solvent extracted, non-hydrogenated paraffinic distillate having at least 9.0 wt. % aromatic content.

The invention provides, in yet another aspect, an electrical article having a sealed housing surrounding one or more electrical devices or conductors bathed in an uninhibited electrical insulating oil comprising a blend of severely hydrotreated naphthenic distillate base oil having a viscosity of from about 50 to about 80 SSU at 38° C. and an aniline point from about 63° to about 84° C. with solvent extracted, non-hydrogenated paraffinic distillate having at least 9.0 wt. % aromatic content.

DETAILED DESCRIPTION

When used with respect to paraffinic distillates the phrase "non-hydrogenated" refers to distillates that have not been hydrofinished, hydrotreated, hydrogenated in the presence of a catalyst or otherwise subjected to a treatment process that materially increases the distillate hydrogen content.

A variety of naphthenic crudes may be employed to make the disclosed base oil. The crude is fractionated to provide a distillate having a suitable flash point, boiling range and viscosity. For base oils used in transformers the distillate open cup flash point may for example be greater than about 146° C. (295° F.), or may be greater than about 149° C. (300° F.). The boiling range for such base oils may for example be between about 204° C. (400° F.) and about 388° C. (730° F.). The viscosity is from about 50 to about 80 SSU at 38° C., for example from about 55 to about 65 SSU at 38° C. The distillate is severely hydrotreated to provide a base oil having an aniline point from about 63° to about 84° C., for example from about 71° to about 77° C. (from about 160° F. to about 170° F.). The hydrotreating conditions preferentially will employ a bimetallic catalyst, relatively low space velocity, relatively high hydrogen pressure and relatively high hydrogen consumption. Recommended hydrotreating conditions are shown below in Table 1:

TABLE 1

| | Recommended Range | Preferred Range |
|---|---|---|
| Space Velocity, v/v/hr | 1 or less | 0.3 to 1 |
| $H_2$ Pressure | More than 6.9 MPa (more than 1000 psig) | 10.3 to 12.4 Mpa (1500 to 1800 psig) |
| Temperature | 300° to 370° C. (572° to 698° F.) | 300° to 370° C. (572° to 698° F.) |
| $H_2$ Treat Rate | More than 22,650 L/barrel (more than 800 SCF/barrel) | 85,000 to 17000 L/barrel (3000 to 6000 SCF/barrel) |

The resulting base oil may for example contain about 10 to about 50 wt. %, or about 25 to about 40 wt. % aromatic hydrocarbons, as measured using ASTM D 2007 clay-gel analysis. A variety of suitable base oils are commercially available, including L-Series Grade 60, B-Series Grade 60 and CROSS TRANS™ 306 oils from Cross Oil Refining and Marketing, Inc.; NYNAS NYTEX™ 501 oil from Nynas Napthenics AB; HYNAP N60HT oil from San Joaquin Refining Co. Inc.; and mixtures thereof. Base oils that do not themselves meet the stated viscosity or aniline point requirements may be blended with one another to provide a base oil that does meet such requirements. For example, HYDROCAL™ 38 and HYDROCAL 100 base oils from Calumet Lubricants Co. respectively have viscosities less than 50 and greater than 80 SSU at 38° C., but may be blended to provide a base oil with a viscosity from about 50 to about 80 SSU at 38° C.

Product specifications for an exemplary severely hydrotreated naphthenic distillate base oil are shown below in Table 2.

TABLE 2

| Test Description | Test Method | Value |
|---|---|---|
| Viscosity, cSt @ 100° C. (212° F.) | ASTM D 445/D 341 | 2.4 |
| Viscosity, cSt @ 40° C. (104° F.) | ASTM D 445/D 341 | 9.6 |
| Viscosity, SUS @ 38° C. (100° F.) | ASTM D 445/D 341 | 60.0 |
| Viscosity, SUS @ 99° C. (210° F.) | ASTM D 445/D 341 | 34.2 |
| API Gravity @ 16° C. (60° F.) | ASTM D 1250 | 27.7 |
| Specific Gravity @ 16° C. | ASTM D 1298 | 0.8888 |
| Flash Point, ° C. (° F.) | ASTM D 92 | 154 (310) |
| Color | ASTM D 1500 | L0.5 |
| Aniline Point, ° C. (° F.) | ASTM D 611 | 73 (163) |
| Pour Point, ° C. (° F.) | ASTM D 5949 | −62 (−80) |
| Refractive Index @ 20° C. (68° F.) | ASTM D 1218 | 1.4849 |
| Sulfur, wt. % | ASTM D 4294 | 0.016 |
| Aromatics, wt. % | ASTM D 2007 | 30.9 |

A variety of paraffinic crudes may be employed to make the disclosed paraffinic distillate. The crude is fractionated to provide a distillate having a suitable flash point, boiling range and viscosity. For base oils used in transformers the distillate open cup flash point may for example be greater than about 146° C. (295° F.), or may be greater than about 149° C. (300° F.). The boiling range for such base oils may for example be between about 204° C. (400° F.) and about 388° C. (730° F.). The viscosity may for example be less than about 100 SSU at 38° C., about 85 SSU at 38° C., or about 70 SSU at 38° C. The distillate is solvent extracted using aromatic-selective solvents and processing conditions that will be familiar to those skilled in the art. Exemplary solvents include phenol, N-methylol pyrrolidinone ("NMP") and furfural. Exemplary processing conditions include temperatures of about 49° C. to about 93° C. (about 120° to about 200° F.) and solvent to oil ratios of about 1:1 to about 2:1. The aromatic content of the extract is more than 9 wt. % as measured using ASTM D 2007 clay-gel analysis. For example, the aromatic content may be about 10 to about 30 wt. %, or about 15 to about 30 wt. % of the total paraffinic distillate weight.

Hydrogenation of the paraffinic distillate (e.g., through hydrofining, hydrofinishing, hydrotreating or other processes involving catalytic contact of the distillate with a hydrogenation catalyst and hydrogen) should be avoided. Without intending to be bound by theory, hydrogenation is believed to remove natural oxidation inhibitors present in the paraffinic distillate, and their removal from the paraffinic distillate is believed to make the disclosed blends less well-suited for use as an electrical insulating oil.

A variety of suitable paraffinic distillate oils are commercially available, for example oils designated as solvent extracted neutral oils such as SN100 or SN70 oils. Product specifications for two exemplary solvent extracted paraffinic distillates are shown below in Table 3 and Table 4:

TABLE 3

| Test Description | Test Method | Value |
|---|---|---|
| Viscosity, cSt @ 100° C. (212° F.) | ASTM D 445/D 341 | 3.4 |
| Viscosity, cSt @ 40° C. (104° F.) | ASTM D 445/D 341 | 15.3 |
| Viscosity, SUS @ 38° C. (100° F.) | ASTM D 445/D 341 | 84.0 |
| Viscosity, SUS @ 99° C. (210° F.) | ASTM D 445/D 341 | 37.9 |
| API Gravity @ 16° C. (60° F.) | ASTM D 1250 | 33.4 |
| Specific Gravity @ 16° C. | ASTM D 1298 | 0.8582 |
| Flash Point, ° C. (° F.) | ASTM D 92 | 207 (405) |
| Color | ASTM D 1500 | L0.5 |
| Aniline Point, ° C. (° F.) | ASTM D 611 | 98 (209) |
| Pour Point, ° C. (° F.) | ASTM D 5949 | −26 (−15) |
| Refractive Index @ 20° C. (68° F.) | ASTM D 1218 | 1.4716 |
| Sulfur, wt. % | ASTM D 4294 | 0.114 |
| Nitrogen | ASTM D 4629 | 19 |
| Basic Nitrogen | UOP 313 | 26 |
| Aromatics, wt. % | ASTM D 2007 | 16.7 |

TABLE 4

| Test Description | Test Method | Value |
|---|---|---|
| Viscosity, SUS @ 38° C. (100° F.) | ASTM D 445/D 341 | 106.9 |
| Viscosity, SUS @ 99° C. (210° F.) | ASTM D 445/D 341 | 39.9 |
| API Gravity @ 16° C. (60° F.) | ASTM D 1250 | 30.6 |
| Specific Gravity @ 16° C. | ASTM D 1298 | 0.8731 |
| Flash Point, ° C. (° F.) | ASTM D 92 | 196 (385) |
| Color | ASTM D 1500 | L0.5 |
| Aniline Point, ° C. (° F.) | ASTM D 611 | 97 (207) |
| Pour Point, ° C. (° F.) | ASTM D 5949 | −37 (−35) |
| Refractive Index @ 20° C. (68° F.) | ASTM D 1218 | 1.4765 |

TABLE 4-continued

| Test Description | Test Method | Value |
|---|---|---|
| Sulfur, wt. % | ASTM D 4294 | 0.443 |
| Nitrogen | ASTM D 4629 | 14 |
| Basic Nitrogen | UOP 313 | 21 |
| Aromatics, wt. % | ASTM D 2007 | 27.87 |

The severely hydrotreated naphthenic base oil and solvent extracted paraffinic distillate may be mixed in any convenient fashion, for example by adding the paraffinic distillate to the naphthenic base oil as a blendback oil. The base oil and paraffinic distillate may be mixed in a variety of ratios. The chosen mixing ratio can readily be selected by persons skilled in the art, and may depend in part on the chosen oils and their viscosities and on whether compliance with all or only some of the IEC 60296, ASTM D 3487 and BS 148 specifications is sought. For example, when a low viscosity base oil and a high viscosity paraffinic distillate are blended, then a relatively larger proportion of the base oil might be needed to meet the IEC 60296 specification than would be the case when a low viscosity base oil and a low viscosity paraffinic distillate are blended. This is due at least in part to the IEC specification's relatively stringent −30° C. low temperature viscosity requirement. If compliance with only the ASTM D 3487 specification (which has a 0° C. low temperature viscosity requirement) is needed, then when blending a naphthenic base oil and a paraffinic distillate of differing viscosities a wider range of mixing ratios might be employed. Thus depending on the chosen oils and desired specifications, the mixing ratio of naphthenic base oil to paraffinic distillate may for example be as high as 98/2, 95/5 or 90/10, and as low as 60/40, 70/30, 75/25 or 80/20. Extenders and other additives may be added to the blend if desired. For example, napthenic base oils that do not themselves meet the stated viscosity or aniline point requirements, and paraffinic distillates that do not have the recited aromatic content may be added as extenders. Other suitable additives will be familiar to those skilled in the art, including pour point depressants, metal passivators and the like. The blend may be dried, filtered, packaged and otherwise processed using techniques that will be familiar to those skilled in the art. The blend may be used in a wide variety of electrical articles that will be familiar to those skilled in the art. Such articles typically will include a sealed housing equipped with an access port through which the disclosed electrical insulating oil may be added, replenished or replaced, and will contain one or more electrical devices or conductors bathed in the electrical insulating oil. Representative electrical articles include transformers, switches, circuit breakers, regulators, controls, overhead and buried cables, power supplies and motors.

The blend desirably is formulated to meet one or more of IEC 60296, (Ed. 3.0 b:2003), ASTM D 3487-00 or BS 148: 1998 (Class II), shown below in Table 5. Where both ASTM and ISO or IEC test methods are listed for a particular property, the ASTM test method is used for measurements relating to the ASTM D 3487 specification and the ISO or IEC test methods are used for measurements relating to the IEC 60296 and BS 148 specifications:

TABLE 5

| Property | Test Method | Specification | | |
|---|---|---|---|---|
| | | IEC 60296 (Ed. 3.0 b:2003) | ASTM D 3487-00 | BS 148: 1998 (Class II) |
| Viscosity at 100° C. (212° F.), max, cSt | ASTM D 445 | | 3.0 | |
| Viscosity at 40° C. (104° F.), max, cSt | ASTM D 445/ISO 3104 | 12 | 12 | 11 |
| Viscosity at 0° C. (32° F.), max, cSt | ASTM D 445 | | 76 | |
| Viscosity at −30° C. (−22° F.), max, cSt | ISO 3104 | 1800 | | 1800 |
| Pour Point, max, ° C. (° F.) | ASTM D 97/ ISO 3016 | −40 (−40) | −40 (−40) | −45 (−49) |
| Water Content, max, ppm | ASTM D 1533/ ISO 60814 | 30 | 35 | 20 |
| Breakdown Voltage, min, kV | ASTM D 877/ IEC 60156 | 30 | 30 | 30 |
| Density, max, g/cm$^3$ | ASTM D 1298/ ISO 3675 | 0.895 @ 20° C. | 0.9100 @ 15° C. | 0.895 @ 20° C. |
| Dielectric Dissipation Factor at 90° C. (194° F.) | IEC 60247 | 0.005 | | 0.005 |
| Power Factor, % @ 25° C. (77° F.) | ASTM D 924 | | 0.05 | |
| Power Factor, % 100° C. (212° F.) | ASTM D 924 | | 0.30 | |
| Acidity, max, mg KOH/g | ASTM D 974/ IEC 62021-1 | 0.01 | 0.03 | 0.03 |
| Interfacial Tension, min, dynes/cm | ASTM D 971/ ISO 6295 | | 40 | |
| Total Sulfur | BS 2000/ISO 14596 | | | |
| Corrosive Sulfur | ASTM D 1275/ DIN 51353 | Non-Corrosive | Non-Corrosive | Non-Corrosive |
| Antioxidant, max, wt. % | ASTM D 2668/ IEC 60666 | ND | ND | ND |
| 2-Furfural, max, mg/kg | IEC 61198 | 0.1 | | 1.0 |
| Oxidation Stability, 72 Hour: | ASTM D 2440 | | | |
| Acid, max, mg KOH/g | | | 0.15 | |
| Sludge, wt. % | | | 0.50 | |
| Oxidation Stability, 164 Hour: | ASTM D 2440/ IEC 61125 | | | |
| Acid, max, mg KOH/g | | 1.2 | 0.30 | 1.2 |
| Sludge, wt. % | | 0.80 | 0.60 | 0.80 |
| Dielectric Dissipation Factor @ 90° C. | IEC 60247 | 0.50 | | |
| Gassing Tendency, max, uL/min | ASTM D 2300/ IEC60628-A | | 30 | 5 |
| Flash Point | ASTM D 92/ ISO 2719 | 135 PMCC | 145 COC | 130 PMCC |
| PCA Content, max, wt. % | BS 2000 Part 346 | 3.0 | | 3.0 |
| PCB Content, ppm | ASTM D 4059/ IEC 61619 | ND | ND | ND |
| Aniline, min-max | ASTM D 611 | | 63-84 | |

The invention is further illustrated in the following non-limiting examples, in which all parts and percentages are by weight unless otherwise indicated.

EXAMPLES 1-3

Blends were prepared by combining the severely hydrotreated naphthenic distillate base oil shown in Table 2 with the solvent extracted, non-hydrogenated paraffinic distillate shown in Table 3, at 95/5 (Example 1), 90/10 (Example 2) and 80/20 (Example 3) mixing ratios. The Example 1 and Example 2 blends met the requirements of IEC 60296 (Ed. 3.0 b:2003), ASTM D 3487-00 and BS 148:1998 (Class II). The Example 3 blend met the requirements of ASTM D 3487-00, and it appeared that a 75/25 blend would likely do so as well. The Example 3 blend met the IEC 60296 (Ed. 3.0 b:2003) oxidation stability requirements (IEC 61125) but did not meet the −30° C. viscosity requirement (ISO 3104).

EXAMPLES 4-6

Using the method of Example 1, blends were prepared by combining the severely hydrotreated naphthenic distillate base oil shown in Table 2 with the solvent extracted, non-hydrogenated paraffinic distillate shown in Table 4, at 95/5 (Example 4), 90/10 (Example 5) and 80/20 (Example 6) mixing ratios. The Example 4 and Example 5 blends met the requirements of IEC 60296 (Ed. 3.0 b:2003), ASTM D 3487-00 and BS 148:1998 (Class II). The Example 6 blend met the requirements of ASTM D 3487-00, and it appeared that a 75/25 blend would likely do so as well. The Example 6 blend met the IEC 60296 (Ed. 3.0 b:2003)oxidation stability requirements (IEC 61125) but did not meet the −30° C. viscosity requirement (ISO 3104).

COMPARISON EXAMPLE 1

A blend was prepared by combining 80 parts of the severely hydrotreated naphthenic distillate base oil shown in Table 2 with 20 parts of CONOSOL™ 260 oil from Penreco Company (a solvent extracted, hydrogenated paraffinic distillate containing less than 1 wt. % aromatics as analyzed using ASTM D 2007 clay-gel analysis). The blend did not meet the requirements of IEC 60296 (Ed. 3.0 b:2003), ASTM D 3487-00 or BS 148:1998 (Class II).

COMPARISON EXAMPLES 2-3

Using the method of Comparative Example 1, a blend was prepared by combining the severely hydrotreated naphthenic distillate base oil shown in Table 2 with ERGON™ West Virginia P70N oil from Ergon Refining, Inc. (a hydrogenated paraffinic distillate containing 6.7 wt. % aromatics as analyzed using ASTM D 2007 clay-gel analysis), at 90/10 (Comparison Example 2) and 80/20 (Comparison Example 3) mixing ratios. The blends did not meet the requirements of IEC 60296 (Ed. 3.0 b:2003), ASTM D 3487-00 or BS 148 (Class II).

COMPARISON EXAMPLE 4

Using the method of Comparative Example 1, a blend was prepared by combining 80 parts of the severely hydrotreated naphthenic distillate base oil shown in Table 2 with 20 parts of EXXON™ EHC -30 oil from Exxon Mobil Corporation (a solvent extracted, hydrogenated paraffinic distillate containing 8.58 wt. % aromatics as analyzed using ASTM D 2007 clay-gel analysis). The blend did not meet the requirements of IEC 60296 (Ed. 3.0 b:2003), ASTM D 3487-00 or BS 148: 1998 (Class II).

COMPARISON EXAMPLES 5-7

The severely hydrotreated naphthenic base oil shown in Table 2 (Comparison Example 5) and the solvent extracted, hydrogenated paraffinic distillates shown in Table 3 (Comparison Example 6) and Table 4 (Comparison Example 7) were individually tested to see if they met the requirements of IEC 60296 (Ed. 3.0 b:2003), ASTM D 3487-00 or BS 148: 1998 (Class II). None did so.

Various modifications and alterations of this invention will be apparent to those skilled in the art without departing from the scope and spirit of this invention. It should be understood that this invention is not limited to the illustrative embodiments set forth above.

We claim:

1. A method for making an uninhibited electrical insulating oil comprising blending severely hydrotreated naphthenic distillate base oil having a viscosity of from about 50 to about 80 SSU at 38° C. and an aniline point from about 63° to about 84° C. with solvent extracted, non-hydrogenated paraffinic distillate having at least 9.0 wt. % aromatic content to provide a blend that meets one or more of IEC 60296 (Ed. 3.0 b:2003), ASTM D 3487-00 or BS 148:1998 (Class II).

2. A method according to claim 1 wherein the base oil viscosity is about 55 to about 65 SSU at 38° C.

3. A method according to claim 1 wherein the base oil has an aniline point of about 71° to about 77° C.

4. A method according to claim 1 wherein the base oil contains about 10 to about 50 wt. % aromatic hydrocarbons.

5. A method according to claim 1 wherein the paraffinic distillate contains about 10 to about 30 wt. % aromatic hydrocarbons.

6. A method according to claim 1 wherein the paraffinic distillate contains about 15 to about 30 wt. % aromatic hydrocarbons.

7. A method according to claim 1 wherein the base oil and paraffinic distillate are blended in a mixing ratio of about 98/2 to about 60/40.

8. A method according to claim 1 wherein the base oil and paraffinic distillate are blended in a mixing ratio of about 95/5 to about 75/25.

9. A method according to claim 1 wherein the blend meets each of IEC 60296 (Ed. 3.0 b:2003), ASTM D 3487-00 and BS 148:1998 (Class II).

10. An uninhibited electrical insulating oil comprising a blend of severely hydrotreated naphthenic distillate base oil having a viscosity of from about 50 to about 80 SSU at 38° C. and an aniline point from about 63° to about 84° C. with solvent extracted, non-hydrogenated paraffinic distillate having at least 9.0 wt. % aromatic content.

11. An oil according to claim 10 wherein the base oil viscosity is about 55 to about 65 SSU at 38° C.

12. An oil according to claim 10 wherein the base oil has an aniline point of about 71° to about 77° C.

13. An oil according to claim 10 wherein the base oil contains about 10 to about 50 wt. % aromatic hydrocarbons.

14. An oil according to claim 10 wherein the paraffinic distillate contains about 10 to about 30 wt. % aromatic hydrocarbons.

15. An oil according to claim 10 wherein the paraffinic distillate contains about 15 to about 30 wt. % aromatic hydrocarbons.

16. An oil according to claim 10 containing the base oil and paraffinic distillate in a mixing ratio of about 98/2 to about 60/40.

17. An oil according to claim 10 containing the base oil and paraffinic distillate in a mixing ratio of about 95/5 to about 75/25.

18. An oil according to claim 10 meeting one or more of IEC 60296 (Ed. 3.0 b:2003), ASTM D 3487-00 or BS 148: 1998 (Class II).

19. An oil according to claim 10 meeting each of IEC 60296 (Ed. 3.0 b:2003), ASTM D 3487-00 and BS 148:1998 (Class II).

20. An electrical article having a sealed housing surrounding one or more electrical devices or conductors bathed in an uninhibited electrical insulating oil comprising a blend of severely hydrotreated naphthenic distillate base oil having a viscosity of from about 50 to about 80 SSU at 38° C. and an aniline point from about 63° to about 84° C. with solvent extracted, non-hydrogenated paraffinic distillate having at least 9.0 wt. % aromatic content.

21. An article according to claim 20 wherein the device comprises a transformer.

22. An article according to claim 20 wherein the device comprises a switch, circuit breaker, regulator, control, cable, power supply or motor.

* * * * *

UNITED STATES PATENT AND TRADEMARK OFFICE

CERTIFICATE OF CORRECTION

PATENT NO. : 7,666,295 B2
APPLICATION NO. : 11/255086
DATED : February 23, 2010
INVENTOR(S) : Patrick et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1161 days.

Signed and Sealed this

Seventh Day of December, 2010

David J. Kappos

David J. Kappos
*Director of the United States Patent and Trademark Office*